US006333132B1

(12) United States Patent
Tomura

(10) Patent No.: US 6,333,132 B1
(45) Date of Patent: Dec. 25, 2001

(54) TONER FOR TWO-COMPONENT DEVELOPER AND COLOR IMAGE FORMING APPARATUS

(75) Inventor: Shinya Tomura, Kanagawa-ken (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/626,164

(22) Filed: Jul. 26, 2000

(30) Foreign Application Priority Data

Jul. 26, 1999 (JP) ..... P11-210993

(51) Int. Cl.[7] ..... G03G 9/08

(52) U.S. Cl. ..... 430/108.7; 430/111.4; 430/45; 399/298

(58) Field of Search ..... 430/106, 108, 430/109, 110, 45, 108.7, 111.4; 399/298

(56) References Cited

U.S. PATENT DOCUMENTS

| | | | | |
|---|---|---|---|---|
| 4,455,361 | * | 6/1984 | Narusawa et al. | 430/108 |
| 4,513,075 | * | 4/1985 | Narusawa et al. | 430/108 |

FOREIGN PATENT DOCUMENTS

| | | |
|---|---|---|
| 63-163469 | 7/1988 | (JP) . |
| 2-27664 | 6/1990 | (JP) . |
| 2541946 | 7/1996 | (JP) . |

* cited by examiner

*Primary Examiner*—John Goodrow
(74) *Attorney, Agent, or Firm*—Foley & Lardner

(57) ABSTRACT

A toner for two-component developer characterized in that the surface area (A) of the toner mother particles containing linear polyester resin and coloring agents and the total projection area (B) of the external additives in diameter less than 50 nm that are added to the surface of the toner mother particles are as follows:

$$75\% \leqq B/A \leqq 150\%$$

13 Claims, 1 Drawing Sheet

TONER FOR TWO-COMPONENT DEVELOPER AND COLOR IMAGE FORMING APPARATUS

BACKGROUND OF THE INVENTION

1. Field of the Invention

The present invention relates to a toner for two-component developer that is used for developing an image in a printer, an electro-photographic apparatus and the like, and a color image forming apparatus for obtaining color images using the toner for two-component developer.

2. Description of the Related Art

In a quadruple tandem type color image forming apparatus for obtaining full color images on sheets of paper, OHP films and the like that are image transferred media, by superposing and fixing toner images in plural colors, it is demanded to get good color reproducibility and also stabilized developer images even in the repetitive image forming.

In a developing device of this sort of full color image forming apparatus, if its developing system is of a one-component magnetic type, a toner containing dark black colored magnetic powder must be used and therefore, such a problem was caused that color reproducibility is worse. Further, if a single-component non-magnetic type developing system is used, although magnetic powder is not contained in a toner core, the toner is electrified between a developing sleeve and a blade through the sliding contact. Therefore, such a problem was caused that the developing sleeve and the blade were stuck by a resin if a soft and quick melting resin having the characteristic of excellent color reproducibility was used. Because of this, a two-component developing system to develop images using a two-component developer comprising toner and carrier by a magnetic brush developing device was so far generally adopted.

For raw material of toner using such a two-component developing system, a quick melting type resin is demanded from the viewpoint of color reproducibility or transparency when images are formed on OHP sheets. So, linear polyester that is a representative quick melting resin has been so far used as a principal component of toner mother particles, and coloring agents and a charge control agent are contained in this linear polyester.

The above-mentioned toner mother particles using the linear polyester as resin have a quick melting characteristic and are excellent in color reproducibility and transparency; however, as being soft, they are inferior in fluidity or caking resistance. Accordingly, in the repetitive image formation, the quality of image is deteriorated as the developing density drops or the fog is generated. On the other hand, fixing and cleaning properties are impaired and the offset to the heat roller tends to occur at the time of fixing. By oil applied to prevent the offset, the quality of image was impaired or the photosensitive drums became dirty due to the insufficient cleaning. Furthermore, as the acid value of the linear polyester is low, the charging function drops due to the repetitive image forming and the electrification became insufficient when repeating the image formation, the fog was generated or the circumference was contaminated by scattering toner.

SUMMARY OF THE INVENTION

The present invention is to solve the above-mentioned problems and it is an object to provide a toner for two-component developer and a color image forming apparatus that is capable of obtaining good fixing and cleaning properties without impairing fluidity or caking resistance of toner that are principally comprising linear polyester capable of obtaining good color reproducibility and transparent of full color images and sufficient image density without causing shortage of toner and drop of electrification property in the repetitive image forming and obtaining good full color images without scattering toner to the circumference.

The present invention provides a toner for two-component developer which is characterized in that the surface area (A) of toner mother particles containing linear polyester resin and coloring agents and the total projection area (B) of external additives in diameter less than 50 nm, that are added to the surface of the toner mother particle is $75\% \leqq B/A \leqq 150\%$.

Further, according to the present invention, a color image forming apparatus is provided. The color image forming apparatus comprises plural image carriers; plural image forming means for forming developer images in different colors on the plural image carriers using a toner for two-component developer of which the surface area (A) of the toner mother particles containing linear polyester resin and coloring agents and the total projection area of an external additive in diameter less than 50 nm that is added to the surface of the toner mother particle is $75\% \leqq B/A \leqq 150\%$; transfer means for transferring the developer images in different colors formed on the plural image carriers on an image receiving medium by superposing; and fixing means for fixing the developer image in different colors transferred on the transfer medium by superposing.

DETAILED DESCRIPTION OF THE PREFERRED EMBODIMENTS

Figure 1:
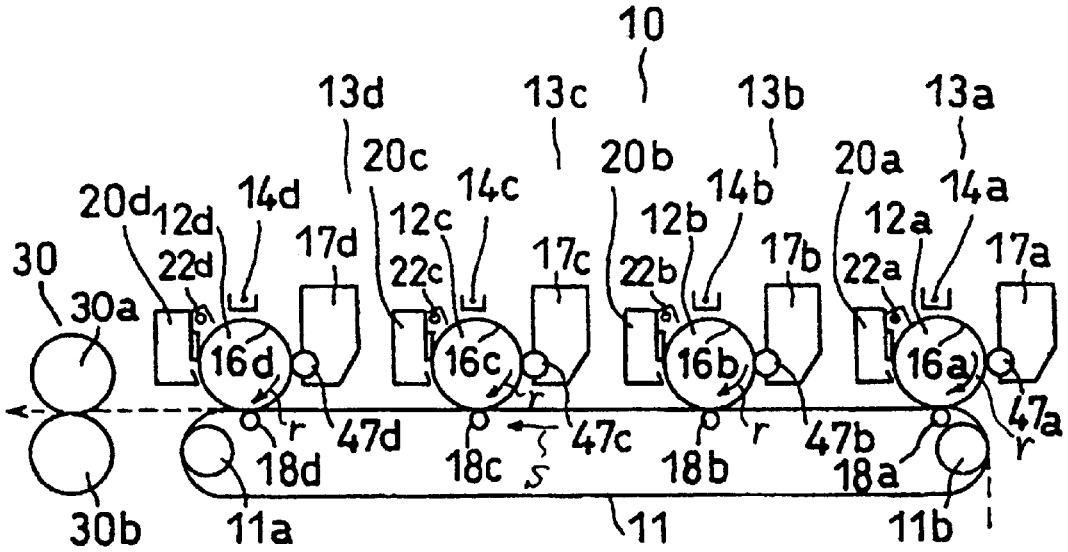
FIG. 1 is a block diagram showing an embodiment of an image forming unit of a color image forming apparatus of the present invention.
Figure 2:
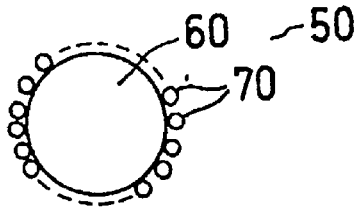
FIG. 2 is an outline diagram showing an embodiment of a toner for two-component developer.

The present invention will be described below referring to embodiments shown in FIG. 1 and FIG. 2. FIG. 1 is a block diagram showing an image forming unit 10 of a laser exposing type quadruple tandem color copying machine that is a color image forming apparatus. First through fourth image forming units 13*a*–13*d* for forming toner images on photosensitive drums 12*a*–12*d*, which are image carriers, using two-component developer in yellow (Y), magenta (M), cyan (c) and black (BK) are arranged in a row along a transferring belt 11. Around the photosensitive drums 12*a*–12*d*, there are main chargers 14*a*–14*d* for uniformly electrifying the photosensitive drums 12*a*–12*d* to a specified potential and exposing devices (not shown) for exposing document image information in yellow, magenta, cyan and black and forming electrostatic latent images on exposing portions 16*a*–16*d* on the photosensitive drums 12*a*–12*d*.

Further, at the downstream in the rotary direction of the photosensitive drums 12*a*–12*d*, two-component developing type developing devices 17*a*–17*d* are provided for the development using two-component developer of yellow (Y), magenta (M), cyan (C) and black (BK). The developing devices 17*a*–17*d* house two-component developer, that will be described later, comprising toners and carrier of magnetic particles covered by an insulating resin that are mixed at a specified ratio. With this two-component developer, a magnetic brush is formed on each of developing rollers 47*a*–47*d* and brought in contact with the opposing photosensitive drums 12*a*–12*d,* that have electrostatic latent images formed thereon, and develops the latent images to visible images.

The developing rollers 47*a*–47*d* are applied with, for instance, developing bias voltage of −300 to −600 V DC voltage superposed with alternating voltage of frequency 1 to 10 kHz, waveform peak voltage 0.5 to 3 kV through a developing bias voltage generating circuit (not shown). Further, in order to maintain a certain distance between the surfaces of non-magnetic sleeves forming the outer surfaces of the developing rollers 47*a*–47*d* and the photosensitive layers of the surfaces of the photosensitive drums 12*a*–12*d,* a guide roller (not shown) is provided at both ends in the longitudinal direction of the developing rollers 47*a*–47*d* or the photosensitive drums 12*a*–12*d.*

A distance between the surfaces of the developing rollers 47*a*–47*d* and the surfaces of the photosensitive drums 12*a*–12*d* at this time is desirable to be 0.1–1 mm. If the distance is less than 0.1 mm, a space between the developing rollers 47*a*–47*d* and the photosensitive drums 12*a*–12*d* may be clogged with the developer and the surfaces of the developing rollers 47*a*–47*d* and the photosensitive drums 12*a*–12*d* can be damaged and images may be adversely affected. On the other hand, if the distance is over 1 mm, toner tends to scatter and images and peripheral devices can be contaminated.

At the downstream of the developing devices 17*a*–17*d* around the photosensitive drums 12*a*–12*d,* charge applying rollers 18*a*–18*d* are provided for giving transferring charge to the back of the transferring belt 11, cleaning devices 20*a*–20*d* and charge eliminating lamps 22*a*–22*d.* The transferring belt 11 is a ring shaped belt made of such a film as 85–150 $\mu$m thick polyamide or denatured polyamide showing semiconductivity of volume resistivity $10^{12}$ Ω/cm. The transferring belt 11 is carried by a drive roller 11*a* for rotating the belt 11 in the arrow direction "s" and a tension roller 11*b.*

The charge applying rollers 18*a*–18*d* have been set so as to apply, for instance, +800 to +3,000 V transferring bias that is gradually increasing toward the downstream of the transferring belt 11. Therefore, while sheets of paper, etc. that are image receiving media are being conveyed in the arrow direction "s" by the transferring belt 11, the photosensitive drums 12*a*–12*d* are charged sequentially from the back of a sheet of paper via the transferring belt 11. By this charging, toner images in yellow (Y), magenta (M), cyan (C) and black (BK) on the photosensitive drums 12*a*–12*d* are multiply transferred on the sheet of paper.

At the upper stream of the image forming unit 10, a paper feed cassette device (not shown) is provided for housing sheets of paper, OHP sheets, etc. that are transfer material. Further, a register roller (not shown) is provided for taking a sheet of paper, etc. from the paper feed cassette device at a timing to bring a sheet of paper to agree with the leading end of a toner image formed on the photosensitive drum 12*a* and for conveying this sheet of paper to the transferring belt 11. At the downstream of the image forming unit 10, a fixing device 30 and a paper receiving tray (not shown) are provided, and a sheet of paper with multiple transferred toner images is ejected on the paper receiving tray after the transferred images are heated and fixed.

A heat roller 30*a* made comprising the fixing device 30 is coated with silicon rubber containing fluorine resin. For a silicon rubber, it is desirable to use perfluoroalkoxyalkane (PFA) resin, polytetrafluoroethylene (PTFE) in hardness 10–40 with a 10–50 $\mu$m thick covering agent. At this time, silicon rubber can contain a plasticizer for controlling hardness. Further, a pressing roller 30*b* is composed of silicon rubber in hardness 20–60 and it is required to make its hardness more softner than that of the heat roller. If hard, silicon rubber is wound round the pressing roller 30*b* and may cause the paper jam. Further, the heat roller 30*a* and the pressing roller 30*b* may be coated with oil in order to prevent adhesion of toner.

Next, a toner for two-component developer that are used for two-component developing devices 17*a*–17*d* that are used in the image forming unit 10 will be described in detail. A toner 50 that is used for the developing devices 17*a*–17*d* contains a coloring agent and resin made of linear polyester having acid value 5–30 KOHmg/g and a glass transition point 45–65° C. that can be quickly melted at the time of fixing so as to get good color reproducibility and transparency. Further, the toner contains toner mother particles 60 that are fine particles containing a toner charging control agent, wax, etc. and external additives 70 that are super fine particles in diameter less than 50 nm comprising inorganic oxide containing silica ($SiO_2$) that is added to the surface of the toner mother particles 60 in order to improve fluidity of the toner mother particles 60 and hold electrostatic charging property.

Here, if an acid value of the linear polyester is less than 5 KOHmg/g, electrostatic charging property of resin becomes weak, compatibility with such external additives as a coloring agent, charging control agent, etc. becomes worse, dispersion becomes worse, and color reproducibility and electrostatic charging property are lowered. On the other hand, if an acid value is above 30 KOHmg/g, electrostatic charging property of resin itself becomes strong but drops in the highly humid state and the charging control of toner becomes difficult.

Further, if the glass transition point of the linear polyester is below 45° C., a toner causes a caking and becomes hard when it is stored. On the other hand, if the glass transition point exceeds 65° C., the toner is not melted at the time of fixing and a problem is caused in color reproducibility and transparency in the full color image forming. The glass transition point can be measured according to the general method, for instance, by measuring energy change in a differential thermal balance. Further, the linear polyester resin can be synthesized according to an ordinary method. Definitely, perform the reaction at a reaction temperature (170–250° C.) and reaction pressure (5 mmHg—normal pressure), and terminate the reaction when the above-mentioned specified physical properties are reached. As a toner charging control agent, a compound that does not affect the quality of image is usable. For instance, boron (B) compounds represented in "Chemical Formula 1" are pointed. Representative boron (B) compounds (1)–(5) are shown in Chemical Formulas 2 to 6. Further, in addition to the boron (B) compounds, it is possible to use salicylic acid derivative shown in Chemical Formula 7, etc.

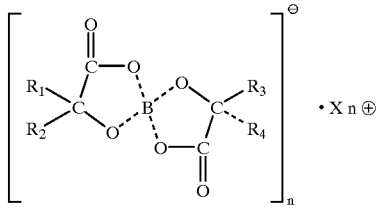

[Chemical Formula 2]

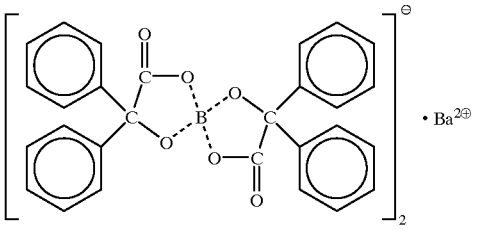

[Chemical Formula 3]

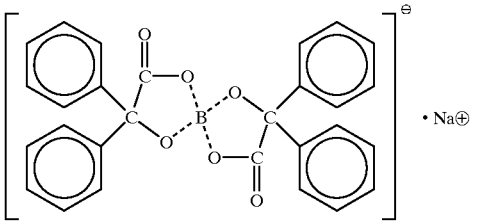

[Chemical Formula 4]

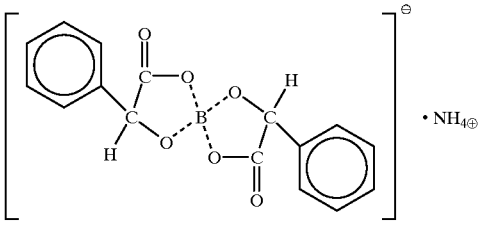

[Chemical Formula 5]

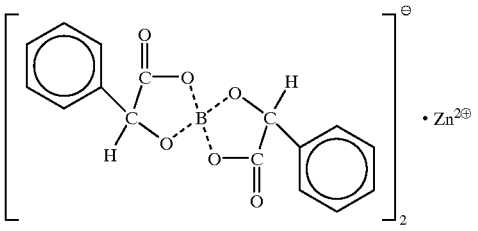

[Chemical Formula 6]

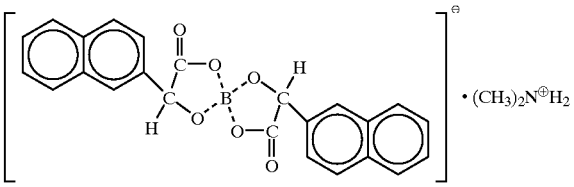

[Chemical Formula 7]

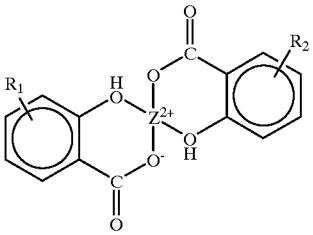

Further, various kinds of coloring agents contained in the toner mother particles 60 are usable. For instance, as pigments for for yellow (Y) coloring agents, nitro pigments such as Naphthol Yellow S, azo pigments such as Hansa Yellow 5G, Hansa Yellow 3G, Hansa Yellow G, Benzidine Yellow GR, Benzidine Yellow G, Vulcan Fast Yellow 5G or such inorganic pigments as Yellow Iron Oxide, Loess, etc. are enumerated. Further, as dyes, there are such oil colors as C.I. Solvent Yellow 2, C.I. Solvent Yellow 6, C.I. Solvent Yellow 14, C.I. Solvent Yellow 15, C.I. Solvent Yellow 16, C.I. Solvent Yellow 19, C.I. Solvent Yellow 21, etc. that are enumerated in the color index.

As pigments for Magenta (M) coloring agents, there are Quinacridone pigments such as C.I. Pigment 122, C.I. Pigment Violet 19, Rhodamine pigments such as Rhodamine 6G Lake, Rhodamine B Lake, C.I. Pigment Red 81, Thioindigo Pigments such as C.I. Pigment Violet 87, C.I. Violet 1, C.I. Pigment violet 38, and azo pigments such as Brilliant Carmine 6B, Lithol Rubine GK, etc. As dyes, there are such oil colors as C.I. Solvent Red 19, C.I. Solvent Red 49, C.I. Solvent Red 52, etc.

For Cyan (C) coloring agents, there are such phthalocyane pigments as Phthalocyanine Blue, Heliogen Blue G, Fast Sky Blue, C.I. Pigment Blue 15, C.I. Pigment Blue 16, C.I. Pigment Blue 17, C.I. Pigment Green 7, C.I. Pigment Green 12, C.I. Pigment Green 36, C.I. Pigment Green 37, C.I. Pigment Green 38, etc. and such oil colors as C.I. Solvent Blue 25, C.I. Solvent Blue 55, C.I. Solvent Blue 70, C.I. Solvent Blue 40, C.I. Solvent Blue 25, C.I. Direct Blue 86, etc.

As black (BK) coloring agents, there are various kinds of carbon blacks manufactured according to the thermal black method, acetylene black method, channel black method, furnace black method, lamp black method, etc. In addition to the above-mentioned coloring agents, products obtained by modifying pigments or dyes are usable or more than two kinds of coloring agents are also usable by blending.

For wax to be contained in the toner mother particular 60, low molecular weight polypropylene, low molecular weight polyethylene, liquid paraffin, acid amide, wax stearate, montan wax, SASOL wax (fischer tropsch wax), custor wax, chloric paraffin, carnauba wax and the like are usable in 0.5–5 weight portion within a range not affecting the color reproduction.

As the external additive 70, silica fine grain, metallic oxide fine grain, cleaning assistant, etc. are used. As silica fine grain, there are silicon dioxide, aluminum silicate, sodium silicate, zinc silicate, magnesium silicate, etc. As fine grains of metallic oxides, there are zinc oxide, titanium oxide, aluminum oxide, zirconium oxide, titanic acid strontium, titanic acid barium, zinc stearate, etc. Further, cleaning assistant is usable as the external additive 70. As a cleaning assistance, there are such resin powder as polymethyl methacrylate, polyviniliden fluoride, polytetrafluoroethylene, etc. They can be used in 0.2–2 weight portion when needed. Further, the external additive 70 may be applied with the surface treatment such as a hydrophobic processing.

When the external additive 70 is added to the toner mother particles 60 in the toner 50 comprising above-mentioned various materials at a rate shown by the following expression:

$$75\% \leqq B/A \leqq 150\%,$$

where the surface area of the toner mother particles 60 is (A) and the total projection area is (B), the overall surface of the toner mother particles 60 is almost covered.

When B/A is lower than 75%, there is such a problem that the soft surface of the toner mother particles 60 comprising a low softening point resin is exposed from the external additive 70, fluidity and electrostatic charging property are impaired and is offset to the heat roller 30*a* side at the time of fixing. On the other hand, when B/A exceeds 150%, there is a problem that the quick melting is impaired and it becomes hard to fix an image.

Further, the ratio of silica ($SiO_2$) and inorganic oxide other than silica ($SiO_2$) in the external additive 70 comprising inorganic oxide including silica ($SiO_2$) is desirable to be as shown below:

$$70\% \leqq C/A \leqq 100\%$$

$$5\% \leqq D/A \leqq 50\%$$

where, the total projection area of silica out of the total projection area (B) of the external additive 70 is (C), the total projection area of other inorganic oxide is (D) and the surface area of the toner mother particles is (A). This is to avoid a problem to cause a problem in fluidity of toner and cause the image deterioration when inorganic oxide other than silica is increased.

The surface area (A) of the toner mother particles 60 was obtained according to "Numerical Formula (1)" assuming that a mean particle size (Rt) is spherical.

$$A=4\pi Rt^2 \quad (1)$$

The total projection area (B) of the external additive 70 of super fine particles was obtained by assuming the number of external additives adhered to the surface of single toner mother particles to be "n" and by obtaining the projection area (S) of one external additive to the toner mother particles and according to "Numerical Formula (2)" that is the product of the projection area (S).

$$B=nS \quad (2)$$

The number of external additives n was obtained according to "Numerical Formula (3)".

$$N=(Dt/Df)(Rt/Rf)^3\{c/(100-c) \quad (3)$$

where, c: concentration of external additive (%), Dt: density of toner mother particles (g/cm$^2$), Df: density of external additive (g/cm$^2$), Rt: mean particle size of toner mother particles (cm), Rf: mean particle size of external additive (cm). Further, in this embodiment the density of silica is 2.2 (g/cm$^2$) and the density of titanium oxide is 4.0 (g/cm$^2$).

The projection area (S) of the external additive was obtained according to "Numerical Formula (4)". Further, the projection area of one silica ($SiO_2$) or inorganic oxide other than silica ($SiO_2$) or was also obtained from "Numerical Formula (4)".

$$S=(\pi Rt^2/2)(1-\sqrt{Rt(Rt+2Rf)}/(Rt+Rf)) \quad (4)$$

Materials of the toner mother particles 60 of the toner 50 are dispersed respectively according to such dry dispersion methods as a high-speed rotary mixer, roll mill, ball mill methods and the like. Thereafter, they are mixed and kneaded respectively according to fusion, mixing and kneading methods by a roll, pressing kneader, internal mixer, screw extruder and the like. After this mixing and kneading, they are coarsely pulverized. After this coarse pulverization, they are finely pulverized by a jet mill, a high-speed rotary pulverizer and the like, further classified using an air current classifier and the toner mother particles 60 and the external additive 70 are manufactured, respectively. Thereafter, using a high-speed rotary mixer represented by the Henshel mixer, the toner mother particles 60 and the external additive 70 are mixed and the toner 50 is obtained. Further, the external additive 70 can be mixed under the condition for making the external additive 70 more effective, for instance, by putting silica ($SiO_2$) and inorganic oxides other than silica ($SiO_2$) jointly or putting separately by kind.

Next, embodiments wherein full color images were formed by the color image forming apparatus using two-component developer will be described in detail referring to Table 1. In this case, various toner mother particles 60 containing linear polyester were manufactured and added with the external additive 70 in a specified quantity and the toner 50 thus obtained was mixed and stirred with carrier and the two-component developer was thus obtained. Further, the photosensitive drums 12*a*–12*d* of the color image forming apparatus used in the embodiments are rotated in the arrow direction "r" at a peripheral velocity 130 mm/sec. On each of the surfaces of the photosensitive drum 12*a*–12*d*, an electrostatic latent image applied with −600 V at its dark portion and −50 V at the light portion was formed and a distance from the non-magnetic sleeves forming the outer surfaces of developing rollers 47*a*–47*d* was set at 0.45 mm. The development was carried out by applying bias voltage of DC −450 V superposed with the alternating field of frequency 4 kHz, waveform peak voltage 1.2 kV to the non-magnetic sleeves. Further, the transferring belt 11 used a 125 μm thick denatured polyamide having volume resistivity $10^{10}$ Ω/cm and multiple toner images were transferred on a sheet of paper by applying 1,000 V as a transferring bias through the back of the transferring belt 11 by charge applying rollers 18*a*–18*d*. In this embodiment, the same transferring bias was applied but a good image was obtained even when multiple images were transferred by applying the transferring bias sequentially at differing potentials of 50–200 V in the range of 800–1,200 V with the downstream of the conveying direction in the arrow direction "s".

Embodiment 1

In this Embodiment 1, a yellow (Y) powder in a mean particle size 8.0 μm comprising 95% of linear polyester having an acid value 10 KOHmg/g and the glass transition point 60° C., 2% of boron (B) compound (1) shown in "Chemical Formula 2" as a charging control agent, 3% of pigment yellow 180 was used as the toner mother particles 60 and added with the external additives 70 comprising 2.5% of 30 nm silica ($SiO_2$) and 0.5% of 20 nm titanium oxide, and mixed by a Henshel mixer and the yellow toner 50 was obtained. At this time, the surface area A of the toner mother particles 60 was $2.01\times10^{-6}$ cm$^2$, the total projection area of the external additive 70 was $2.2\times10^{-6}$ cm$^2$, the total projection area C of silica ($SiO_2$) was $1.89\times10^{-6}$ cm$^2$ and the total projection area D of titanium oxide was $0.306\times10^{-6}$ cm$^2$. Accordingly, the ratio (B/A) of the total projection area (B) of the external additives 70 to the surface area (A) of the toner mother particles 60 became 109%. Further, the total projection area (C) of silica ($SiO_2$) to the surface area (A) of the toner mother particles 60 (C/A) was 94% or the ratio of total projection area (D) of titanium oxide to the toner mother particles 60 (D/A) was 15%. 5 weight portion of the yellow toner was mixed with 95 weight portion of ferrite particles covered by resin mainly comprising silicon resin in a mixer and a yellow two-component developer was formed.

In the similar manner, a magenta (M) toner was obtained using magenta (M) powder in a mean particle size 8.1 μm with the surface area A of $2.06\times10^{-6}$ cm$^2$ comprising 93 weight portion of linear polyester of an acid value 10

KOHmg/g and a glass transition point 60° C., 2 weight portion of boron (B) compound (1) shown in "Chemical Formula (2)" and 5 weight portion of pigment red 184 as the toner mother particles and added with the external additives in the same amount as the yellow toner. As the result, (B/A) was 107%, (C/A) was 92% and (D/A) was 15%.

A cyan (C) toner was obtained using cyan (C) powder in a mean particle size 7.9 $\mu$m with the surface area A of $1.96\times10^{-6}$ $cm^2$ comprising 94 weight portion of linear polyester having an acid value 10 KOHmg/g and a glass transition point 60° C., 2 weight portion of boron (B) compound (1) shown in "Chemical Formula 2" and 4 weight portion of phthlocyanine blue as the toner mother particles and adding the external additives in the same amount as the yellow toner. As the result, (B/A) was 112%, (C/A) was 96% and (D/A) was 16%.

A black (BK) toner was obtained using black (BK) powder in a mean particle size 8.2 $\mu$m with the surface area A $2.11\times10^{-6}$ $cm^2$ comprising 93 weight portion of linear polyester having an acid value 10 KOHmg/g and a glass transition point 60° C., 2 weight portion of boron (B) compound (1) shown in "Chemical Formula 2" and 5 weight portion of carbon black as the toner mother particles added with external additives in the same amount as the yellow toner and mixed in a mixer. As the result, (B/A) was 104%, (C/A) was 90% and (D/A) was 15%.

Two-component developer in magenta (M), cyan (C) and black (BK) colors were formed by mixing 5 weight portion of each magenta (M), cyan (C) and black (BK) toners with 95 weight portion of ferrite particles, and when they were put in the developing devices 17*a*–17*d* jointly with yellow two-component developer and a full color image was formed on a sheet of paper by the image forming unit 10, a clear full color image excellent in color reproducibility without fog and in the good gradation was obtained. Further, even after the repeated image formation of 20,000 sheets, a stabilized image that is almost the same as the initial image could be obtained and the two-component developer did not cause the caking. Further, a full color image formed on an OHP sheet showed good transparency. Further, at both the high temperature and humid state (30° C., 85% RH) and the low temperature and low humid state (10° C., 20% RH), a stabilized full color image could be obtained. On 64–104 g ordinary sheets of paper, a good fixing characteristic was obtained at 140–160° C. without causing offset. On 127–210 g thick sheets of paper, good fixing characteristic was obtained at 170–180 and no offset was caused.

TABLE 1

| | Kind of toner | Resin: Kind | Resin: Acid value (KOH mg/g) | Resin: Tg ° C. | Resin: Parts by weight | Charge control agent: Kind | Charge control agent: Parts by weight | External additive: Kind | External additive: Particle size | External additive: Parts by weight | Fine particle: Particle size (dia.) (μm) | Fine particle: Surface area (A) ($cm^2$) × $10^{-6}$ | Projection area of super fine particle (B) ($cm^2$) × $10^{-6}$ | Silica (C) ($cm^2$) × $10^{-6}$ | Inorganic oxide (D) ($cm^2$) × $10^{-6}$ | B/A (%) | C/A (%) | D/A (%) | Image characteristic | Transparency |
|---|---|---|---|---|---|---|---|---|---|---|---|---|---|---|---|---|---|---|---|---|
| Embodiment 1 | Yellow toner | Linear polyester | 10 | 60 | 95 | (1) | 2 | Silica oxide/ Titanium | 30 nm 20 nm | 2.5 0.5 | 8 | 2.01 | 2.2 | 1.69 | 0.306 | 109 | 94 | 15 | ○ | ○ |
| | Magenta toner | Linear Polyester | 10 | 60 | 95 | (1) | 2 | Silica oxide/ Titanium | 30 nm 20 nm | 2.5 0.5 | 8.1 | 2.06 | 2.2 | 1.89 | 0.306 | 107 | 92 | 15 | ○ | ○ |
| | Cyan Toner | Linear Polyester | 10 | 60 | 94 | (1) | 2 | Silica oxide/ Titanium | 30 nm 20 nm | 2.5 0.5 | 7.9 | 1.96 | 2.2 | 1.89 | 0.306 | 112 | 96 | 16 | ○ | ○ |
| | Black toner | Linear Polyester | 10 | 60 | 93 | (1) | 2 | Silica oxide/ Titanium | 30 nm 20 nm | 2.5 0.5 | 8.2 | 2.11 | 2.2 | 1.89 | 0.306 | 104 | 90 | 15 | ○ | ○ |
| Yellow toner is shown below as a representative toner. | | | | | | | | | | | | | | | | | | | | |
| 2 | Yellow toner/Linear Polyester Other colored toners are also the same. | | 5 | 65 | 95 | (1) | 2 | Silica oxide/ Titanium | 30 nm 20 nm | 2.5 0.5 | 8.2 | 2.11 | 2.2 | 1.89 | 0.306 | 104 | 90 | 15 | ○ | ○ |
| 3 | Yellow toner/Linear Polyester Other colored toners are also the same. | | 30 | 45 | 95 | (4) | 2 | Silica oxide/ Titanium | 30 nm 20 nm | 2.5 0.5 | 8.5 | 2.27 | 2.2 | 1.89 | 0.306 | 97 | 83 | 13 | ○ | ○ |
| 4 | Yellow toner/Linear Polyester Other colored toners are also the same. | | 30 | 45 | 94 | (6) | 2 | Silica oxide/ Titanium Zinc stearate | 30 nm 20 nm 4 μm | 2.5 0.5 1 | 8 | 2.01 | 2.2 | 1.89 | 0.306 | 109 | 94 | 15 | ○ | ○ |
| Comparative Example | | | | | | | | | | | | | | | | | | | | |
| 1 | Yellow toner/Linear Polyester Other colored toners are also the same. | | 3 | 60 | 95 | (4) | 2 | Silica oxide/ Titanium | 30 nm 20 nm | 2.5 0.5 | 8.2 | 2.11 | 2.2 | 1.89 | 0.306 | 104 | 90 | 15 | Δ | Δ |

TABLE 1-continued

| | Kind of toner | Resin Kind | Resin Acid value (KOH mg/g) | Resin Tg ° C. | Resin Parts by weight | Charge control agent Kind | Charge control agent Parts by weight | External additive Kind | External additive Particle size | External additive Parts by weight | Fine particle Particle size (dia.) (μm) | Fine particle Surface area (A) ($cm^2$) × $10^{-6}$ | Projection area of super fine particle (B) ($cm^2$) × $10^{-6}$ | Silica (C) ($cm^2$) × $10^{-6}$ | Inorganic oxide (D) ($cm^2$) × $10^{-6}$ | B/A (%) | C/A (%) | D/A (%) | Image characteristic | Transparency |
|---|---|---|---|---|---|---|---|---|---|---|---|---|---|---|---|---|---|---|---|---|
| 2 | Yellow toner/Linear Polyester Other colored toners are also the same. | | 10 | 60 | 95 | Chrome Compound | 2 | Silica oxide/ Titanium | 30 nm 20 nm | 2.5 0.5 | 8.5 | 2.27 | 2.2 | 1.89 | 0.306 | 97 | 83 | 13 | X | X |
| 3 | Yellow toner/Linear Polyester Other colored toners are also the same. | | 10 | 60 | 95 | (1) | 2 | Silica oxide/ Titanium | 30 nm 20 nm | 3 1.5 | 8 | 2.06 | 3.21 | 2.28 | 0.93 | 156 | 111 | 45 | X | ○ |
| 4 | Yellow toner/Linear Polyester Other colored toners are also the same. | | 10 | 60 | 95 | (1) | 2 | Silica oxide/ Titanium | 30 nm 20 nm | 1.5 0.5 | 8 | 2.06 | 1.43 | 1.12 | 0.31 | 69 | 54 | 15 | X | ○ |
| 5 | Yellow toner | Styrene-Acrylic resin | 10 | 60 | 95 | (1) | 2 | Silica oxide/ Titanium | 30 nm 20 nm | 2.5 0.5 | 8 | 2.01 | 2.2 | 1.89 | 0.306 | 109 | 94 | 15 | Δ | X |

Embodiment 2

In Embodiment 2, linear polyester having an acid value and a glass transition point differing from Embodiment 1 was used and all others are the same as in Embodiment 1. Therefore, a yellow toner will be described in detail as a representative toner referring to Embodiment 1. A yellow toner was obtained using yellow (Y) powder in a mean particle size 8.2 μm comprising 95 weight portion of linear polyester having an acid value 5 KOHmg/g and a glass transition point 65° C., 2 weight portion of boron (B) compound (1) shown in "Chemical Formula 2" and 3 weight portion of pigment yellow 180 as toner mother particles added with 2.5 weight portion of 30 nm silica ($SiO_2$) and 0.5 weight portion of 20 m titanium as external additives and mixed with a Henshel mixer.

At this time, the surface area A of the toner mother particles was $2.11\times10^{-6}$ $cm^2$, the total projection area B of the external additives was $2.2\times10^{-6}$ $cm^2$, the total projection area C of silica ($SiO_2$) was $1.89\times10^{-6}$ $cm^2$ and the total projection area D of titanium oxide was $0.306\times10^{-6}$ $cm^2$. Accordingly, a ratio (A/B) of the total projection area (B) of the external additives to the surface area (A) of the toner mother particles became 104%. Further, the ratio (C/A) of the total projection area (C) of silica ($SiO_2$) or the total projection area (D) of titanium oxide to the surface area (A) of the toner mother particles became 90% and (D/A) became 15%. Two-component yellow developer was formed by mixing 5 weight portion of the above-mentioned yellow toner with 95 weight portion of ferrite particle covered by a resin comprising mainly silicon resin by a mixer.

In the similar manner, two-component developer in magenta (M), cyan (C) and black (BK) colors were formed and by putting these developer into the developing devices 17*a*–17*d,* a full color image was formed on a sheet of paper by the image forming unit 10. However, in this embodiment, a distance between non-magnetic sleeves forming the outer surfaces of the developing rollers 47*a*–47*d* and the photosensitive drums 12*a*–12*d* was set at 0.3 mm and the development was carried out by applying DC bias voltage of −400 V superposed with alternating voltage of frequency 3 kHz and waveform peak voltage 0.7 kV to the non-magnetic sleeves.

As the result, similar to Embodiment 1, a clear full color image excellent in color reproducibility, less fog and good gradation could be obtained. Further, even after the repeated image formation of 20,000 sheets, a stabilized image that was almost the same as the initial image could be obtained. Further, in either the high temperature and humid state (30° C., 85% RH) and the low temperature and low humid state (10° C., 20% RH), a stabilized full color image was obtained.

Embodiment 3

Embodiment 3 is the same as Embodiment 1 except a linear polyester having a difference acid value and glass transition point and a different boron (B) compound were used. Therefore, a yellow toner as a representative toner will be described in detail referring to Embodiment 1. A yellow toner was obtained by using yellow (Y) powder in a mean particle size 8.5 μm comprising 95 weight portion of linear polyester having an acid value 30 KOHmg/g and a glass transition point 45° C., 2 weight portion of boron (B) compound (4) shown in "Chemical Formula 5" and 3 weight portion of pigment yellow 180 as toner mother particles added with 2.5 weight portion of 30 nm silica ($SiO_2$) and 0.5 weight portion of 20 nm titanium oxide as external additives and mixing these materials in the Henshel mixer, a yellow toner was obtained.

At this time, the surface area A of the toner mother particles was $2.27\times10^{-6}$ $cm^2$, the total projection area B of the external additives was $2.2\times10^{-6}$ $cm^2$, the total projection area C of silica ($SiO_2$) was $1.89\times10^{-6}$ $cm^2$ and the total projection area D of titanium oxide was $0.306\times10^{-6}$ $cm^2$. Accordingly, the ratio (B/A) of the total projection area (B) of the external additives to the surface area (A) of the toner mother particles became 97%. Further, the ratio (C/A) of the total projection area (C) of the silica ($SiO_2$) or the total projection area (D) of the titanium oxide to the surface area (A) of the toner mother particles was 83% and (D/A) was 13%. Then, two-component yellow developer was formed by mixing 5 weight portion of the above-mentioned yellow toner with 95 weight portion of ferrite particle covered by a resin comprising mainly silicon resin by a mixer and yellow two-component developing agnents were formed.

In the similar manner, two-component developer in magenta (M), cyan (C) and black (BK) colors were formed and by putting these developer into the developing devices 17*a*–17*d,* a full color image was formed on a sheet of paper by the image forming unit 10. However, in this embodiment, a distance between non-magnetic sleeves forming the outer surfaces of the developing rollers 47*a*–47*d* and the photosensitive drums 12*a*–12*d* was set at 1 mm the development was carried out by applying DC −500 V bias voltage superposed with alternating voltage of frequency 6 kHz and waveform peak voltage 2 kV to the non-magnetic sleeves.

As the result, similar to Embodiment 1, a clear full color image less fog and good gradation could be obtained without impairing color reproducibility and transparency. Further, even after the repeated image formation of 20,000 sheets of paper, a stabilized image that was almost the same as the initial image could be obtained. Further, both in the high temperature and humid state (30° C., 85% RH) and the low temperature and low humid state (10° C., 20% RH), a stabilized full color image could be obtained.

Embodiment 4

Embodiment 4 is the same as Embodiment 3 except that a different charge control agent was used and further, a different external additive was used. So, a yellow toner will be described in detail as a representative toner referring to Embodiment 3. A yellow toner was obtained using yellow (Y) powder in a mean particle size 8 μm comprising 95 weight portion of linear polyester having an acid value 30 KOHmg/g and a glass transition point 45° C., 2 weight portion of zirconium complex that is a salicyic acid derivative shown in "Chemical Formula 7" and 3 weight portion of pigment yellow 180 as toner mother particles added with 2.5 weight portion of 30 nm silica ($SiO_2$), 0.5 weight portion of 20 nm titanium oxide and 1 weight portion of zinc stearate as external additives and mixing these materials in the Henshel mixer.

At this time, the surface area A of the toner mother particles was $2.01\times10^{-6}$ $cm^2$, the total projection area B of the external additive was $2.2\times10^{-6}$ $cm^2$, the total projection area C of silica ($SiO_2$) was $1.89\times10^{-6}$ $cm^2$ and the total projection area D of titanium oxide was $0.306\times10^{-6}$ $cm^2$. Accordingly, the ratio (B/A) of the total projection area (B) of the external additives to the surface area (A) of the toner mother particles became 109%. Further, the ratio (C/A) of the total projection area (C) of the silica ($SiO_2$) or the total projection area (D) of the titanium oxide to the surface area (A) of the toner mother particles became 94% and (D/A)

became 15%. Then, two-component yellow developer was obtained by mixing 5 weight portion of the above-mentioned yellow toner with 95% weight portion of ferrite particle covered by a resin mainly comprising silicon resin in a mixer.

In the similar manner, two-component developer in magenta (M), cyan (C) and black (BK) colors were formed and by putting these developer into the developing devices 17*a*–17*d*, a full color image was formed on a sheet of paper by the image forming unit 10. However, in this embodiment, a distance between the developer devices 17*a*–17*d* and the photosensitive drums 12*a*–12*d* and developing bias voltage were set at the same as those in Embodiment 3.

As the result, similar to Embodiment 1, a clear full color image less fog and good gradation could be obtained without impairing color reproducibility and transparency. Further, even after the repeated image formation of 20,000 sheets of paper, a stabilized image that is almost the same as the initial image could be obtained. Further, both in the high temperature and humid state (30° C., 85% RH) and the low temperature and low humid state (10° C., 20% RH), a stabilized full color image could be obtained.

Against the above-mentioned Embodiments, comparative examples will be described below. For each of these comparative examples, a yellow toner will be described as a representative toner.

Comparative Example 1

In Comparative Example 1, yellow toner was obtained using yellow (Y) powder in a mean particle size 8.2 μm comprising 95 weight portion of linear polyester having an acid value 3 KOHmg/g and a glass transition point 60° C., 2 weight portion of boron (B) compound (4) shown in "Chemical Formula 5" as a charging control agent and 3 weight portion of pigment yellow 180 as toner mother particles added with 2.5 weight portion of 30 nm silica ($SiO_2$) and 0.5 weight portion of 20 nm titanium oxide as external additives and mixing these materials in the Henshel mixer.

At this time, the surface area A of the toner mother particles was $2.11\times10^{-6}$ $cm^2$, the total projection area B of the external additive was $2.2\times10^{-6}$ $cm^2$, the total projection area C of silica ($SiO_2$) was $1.89\times10^{-6}$ $cm^2$ and the total projection area D of titanium oxide was $0.306\times10^{-6}$ $cm^2$. Accordingly, the ratio (B/A) of the total projection area (B) of the external additive to the surface area (A) of the toner mother particles became 104%. Further, the ratio (C/A) of the total projection area (C) of the silica ($SiO_2$) or the total projection area (D) of the titanium oxide to the surface area (A) of the toner mother particles became 90% and (D/A) became 15%. Then, two-component yellow developer was formed by mixing 5 weight portion of the above-mentioned yellow toner with 95 weight portion of ferrite particle covered by a resin mainly comprising silicon resin by a mixer.

In the similar manner, two-component developer in magenta (M), cyan (C) and black (BK) colors were formed and by putting these developer into the developing devices 17*a*–17*d*, a full color image was formed on a sheet of paper by the image forming unit 10. However, in this embodiment, the development was carried out with a distance between the non-magnetic sleeves forming the developer rollers 47*a*–47*d* and the photosensitive drums 12*a*–12*d* set at 0.5 mm and bias voltage of DC −450 V superposed with alternating field of frequency 4 kHz and waveform peak voltage 1.2 kV applied.

As a result, at the initial stage a clear full color image could be obtained without generating fog and with a good gradation; however, as the acid value of the linear polyester was low and compatibility with coloring agents and external additives was worse, the range of color reproducibility was narrowed and transparency on an OHP sheet of paper was inferior. Furthermore, as the acid value of the linear polyester was low and electrostatic charging property of toner was weak and further, as compatibility with coloring agents and external additives was worse and dispersion became further worse, when an image was repeatedly formed, an image was deteriorated and toner scattering was caused at the image formation of 10,000 sheets.

Comparison Example 2

Comparison Example 2 differs from Embodiment 1 in the charge control agent. That is, a yellow toner was obtained using yellow (Y) powder in a mean particle size 8.2 μm comprising 95 weight portion of linear polyester having an acid value 10 KOHmg/g and a glass transition point 60° C., 2 weight portion of chrome compound as a charge control agent and 3 weight portion of pigment yellow 180 as toner mother particles added with 2.5 weight portion of 30 nm silica ($SiO_2$) and 0.5 weight portion of 20 nm titanium oxide as external additives and mixing these materials in the Henshel mixer.

At this time, the surface area A of the toner mother particles was $2.27\times10^{-6}$ $cm^2$, the total projection area B of the external diameter was $2.2\times10^{-6}$ $cm^2$, the total projection area C of silica ($SiO_2$) was $1.89\times10^{-6}$ $cm^2$ and the total projection area D of titanium oxide was $0.306\times10^{-6}$ $cm^2$. Accordingly, the ratio (B/A) of the total projection area (B) of the external additive to the surface area (A) of the toner mother particles became 97%. Further, the ratio (C/A) of the total projection area (C) of the silica ($SiO_2$) or the total projection area (D) of the titanium oxide to the surface area (A) of the toner mother particles became 83% and (D/A) became 13%. Then, two-component yellow developer was formed by mixing 5 weight portion of the above-mentioned yellow toner with 95 weight portion of ferrite particle covered by a resin mainly comprising silicon resin by a mixer.

In the similar manner, two-component developer in magenta (M), cyan (C) and black (BK) colors were formed and by putting these developer into the developing devices 17*a*–17*d*, a full color image was formed on a sheet of paper by the image forming unit 10. However, in this embodiment, a distance between the developer rollers 47*a*–47*d* and the photosensitive drums 12*a*–12*d* and a developing bias voltage were set at the same as those in Comparative Example 1.

As a result, because a colored chrome containing charge control agent was used, a toner color was adversely affected and even at the initial stage, color reproducibility was bad, and when an image was transferred on an OHP sheet, the transferred image became muddy by the color of chrome and transparency was lacked.

Comparative Example 3

Comparative Example 3 differs from Embodiment 1 in added amount of external additives. That is, a yellow toner was obtained using yellow (Y) powder in a mean particle size 8 μm comprising 95 weight portion of linear polyester having an acid value 10 KOHmg/g and a glass transition point 60° C., 2 weight portion of Boron (B) compound showing in "Chemical Formula 2" as a charge control agent and 3 weight portion of pigment yellow 180 added with 3 weight portion of 30 nm silica ($SiO_2$), and 1.5% of 20 nm titanium oxide as external additives and mixing these materials in the Henshel mixer.

At this time, the surface area A of the toner mother particles was $2.06\times10^{-6}$ $cm^2$, the total projection area B of the external additive was $3.21\times10^{-6}$ $cm^2$, the total projection area C of silica ($SiO_2$) was $2.28\times10^{-6}$ $cm^2$ and the total projection area D of titanium oxide was $0.93\times10^{-6}$ $cm^2$. Accordingly, the ratio (B/A) of the total projection area (B) of the external additives to the surface area (A) of the toner mother particles became 156%. Further, the ratio (C/A) of the total projection area (C) of the silica ($SiO_2$) to the surface area (A) of the toner mother particles became 111% and the ratio (D/A) of the total projection area (D) of the titanium oxide to the surface area (A) of the toner mother particles became 45%. Then, two-component yellow developer was formed by mixing 5 weight portion of the above-mentioned yellow toner with 95 weight portion of ferrite particle covered by a resin mainly comprising silicon resin by a mixer.

In the similar manner, two-component developer in magenta (M), cyan (C) and black (BK) colors were formed and by putting these developer into the developing devices 17*a*–17*d,* a full color image was formed on a sheet of paper by the image forming unit 10. However, in this embodiment, a distance between the developer rollers 47*a*–47*d* and the photosensitive drums 12*a*–12*d* and a developing bias voltage were set at the same as those in Comparative Example 1.

As the result, color reproducibility was good and excellent transparency could be obtained on an OHP sheet; however, as the added amount of titanium oxide, that was inorganic oxide of an external additive, was such, fluidity of the toner became worse and an image was deteriorated due to drop of the toner density. This is because fluidity of titanium oxide that is an inorganic oxide of an external additive was inferior than silica ($SiO_2$) and also, fluidity of the developer was adversely affected and toner was not sufficiently supplied.

Comparative Example 4

Comparative Example 4 differs from Embodiment 1 in added amount of external additives. That is, a yellow toner was obtained using yellow (Y) powder in a mean particle size 8 $\mu$m comprising 95 weight porion of linear polyester having an acid value 10 KOHmg/g and a glass transition point 60° C., 2 weight porion of Boron (B) compound (1) showing in "Chemical Formula 2" as a charge control agent and 3 weight porion of pigment yellow 180 added with 1.5 weight porion of 30 nm silica ($SiO_2$), and 0.5 weight porion of 20 nm titanium oxide as external additives and mixing these materials in the Henshel mixer.

At this time, the surface area A of the toner mother particles was $2.06\times10^{-6}$ $cm^2$, the total projection area B of the external additives was $1.43\times10^{-6}$ $cm^2$, the total projection area C of silica ($SiO_2$) was $1.12\times10^{-6}$ $cm^2$ and the total projection area D of titanium oxide was $0.31\times10^{-6}$ $cm^2$. Accordingly, the ratio (B/A) of the total projection area (B) of the external additives to the surface area (A) of the toner mother particles became 69%. Further, the ratio (C/A) of the total projection area (C) of the silica ($SiO_2$) or the ratio (D/A) of the total projection area (D) of the titanium oxide to the surface area (A) of the toner mother particles became 54% and became 15%, respectively. Then, two-component yellow developer was formed by mixing 5 weight porion of the above-mentioned yellow toner with 95 weight porion of ferrite particles covered by resin comprising principally silicon resin.

In the similar manner, two-component developer in magenta (M), cyan (C) and black (BK) colors were formed and by putting these developer into the developing devices 17*a*–17*d,* a full color image was formed on a sheet of paper by the image forming unit 10. However, in this embodiment, a distance between the developer rollers 47*a*–47*d* and the photosensitive drums 12*a*–12*d* and a developing bias voltage were set at the same as those in Embodiment 1.

As the result, good color reproducibility and excellent transparency could be obtained on an OHP sheet; however, because an amount of added silica ($SiO_2$) added for improving fluidity was small, fluidity of toner became inferior, and good electrostatic charging property could not be obtained and images were deteriorated due to drop of toner density and contrast. Furthermore, the fixing was also deteriorated and offset was caused.

Comparative Example 5

Comparative Example 5 used system-acrylic resin instead of linear polyester resin used in Embodiment 1. That is, a yellow toner was obtained using yellow (Y) powder in a mean particle size 8 $\mu$m comprising 95 weight porion of styrene-acrylic resin having an acid value 10 KOHmg/g and a glass transition point 60° C., 2 weight porion of Boron (B) compound (1) shown in "Chemical Formula 2" as a charge control agent and 3 weight porion of pigment yellow 180 added with 2.5 weight porion of 30 nm silica ($SiO_2$) and 0.5 weight porion of 20 nm titanium oxide as external additives and mixing these materials in the Henshel mixer.

At this time, the surface area A of the toner mother particles was $2.01\times10^{-6}$ $cm^2$, the total projection area B of the external additives was $2.2\times10^{-6}$ $cm^2$, the total projection area C of silica ($SiO_2$) was $1.89\times10^{-6}$ $cm^2$ and the total projection area D of titanium oxide was $0.306\times10^{-6}$ $cm^2$. Accordingly, the ratio (B/A) of the total projection area (B) of the external additives to the surface area (A) of the toner mother particles became 109%. Further, the ratio (C/A) of the total projection area (C) of the silica ($SiO_2$) or the raio (D/A) of the total projection area (D) of the titanium oxide to the surface area (A) of the toner mother particles became 94% and 15%, respectively. Then, two-component yellow developer was formed by mixing 5 weight porion of the above-mentioned yellow toner with 95 weight porion of ferrite particles covered by resin comprising principally silicon resin.

In the similar manner, two-component developer in magenta (M), cyan (C) and black (BK) colors were formed using styrene-acrylic resin and by putting these developer into the developing devices 17*a*–17*d,* a full color image was formed on a sheet of paper by the image forming unit 10. In this embodiment, a distance between the developer rollers 47*a*–47*d* and the photosensitive drums 12*a*–12*d* and a developing bias voltage were set at the same values as those in Embodiment 1.

As the result, because the styrene-acrylic resin was not quickly melted, shadows of particles were generated, color reproducibility was worse and transparency on an OHP sheet was inferior when an image was fixed.

From the above result, it was revealed that within the range of $75\% \leqq B/A \leqq 150\%$, where A is the surface area of toner mother particles and B is the total projection area of external additives, fluidity and electrostatic charging property of linear polyester that is quickly melted and capable of achieving good color reproducibility and transparency can be improved, a stabilized image can be obtained without causing drop of image density and fog even in the repeated image formation, and contamination of the circumference can be prevented without scattering toners. Further, it was revealed that the fixation is also excellent and the offset to the heat roller 30*a* is also prevented.

In the case of the above-mentioned structure, when the external additives 70 are added to the surface of the toner mother particles 60 mainly comprising linear polyester, that is capable of achieving color reproducibility and transparency of a full color image as multi-transferred toners are quickly melted, in the range of 75%≦B/A≦150%, where B is the total projection area of the external additive and A is the surface area of the toner mother particles, fluidity of the toner can be increased and further, stabilized charging property can be obtained. From this, even in the repeated image formation, a clear full color image that has a sufficient density, less fog and in good gradation can be obtained. Further, the stain by scattered tone is reduced and the caking can be prevented. Furthermore, as the nearly overall surface of the soft toner mother particles 60 are covered with the external additives 70, the offset to the heat roller 30*a* is reduced, oil that is coated for preventing the offset also can be reduced and the possibility for the image quality stain by oil is eliminated. Further, the cleaning property of the photosensitive drums is also improved, the maintenance is reduced and the life of the photosensitive drums can be extended.

Further, the present invention is not restricted to the above-mentioned embodiments but the various design modifications can be made. For instance, within a range not impairing the quick melting, the characteristic of linear polyester is not restricted but to obtain more better electrostatic charging property, an acid value is desirable at 5–30 KOHmg/g. To obtain more better color reproducibility and caking resistance, a glass transition point is desirable at 45–60° C. Further, any coloring agents, charge control agents and the like are usable provided that they are capable of realizing more better image quality. Inorganic oxides for external additives are also not limited.

Further, it is allowable to improve the quality of solid image by reciprocating image carriers at the developing unit without being restricted to the structure, operation, etc. of a color image forming apparatus, and materials of the transferring belt and the developing rollers are optional.

As described above, according to the present invention, the nearly overall surface of the toner mother particles comprising mainly linear polyester for realizing the quick melting of multi-transferred toners was covered by super fine particle external additives comprising inorganic oxides containing silica. As a result, on a full color image, fluidity of toners is improved and stabilized electrostatic charging property can be obtained without impairing color reproducibility and transparency. Accordingly, even in the repeated image formation, a clear full color image of good gradation in the sufficient image density without generating fog and the quality of image can be improved. Further, the stain of an image and the circumference by scattering of toners is prevented and caking of two-component developer due to secular change is also provided. In addition, the offset to the fixing roller is prevented, amount of oil applied to the fixing roller can be reduced, stain of an image by oil can be eliminated and a good image is obtainable. Furthermore, the cleaning property can be improved, the necessity of maintenance is reduced and the long life of the photosensitive drums can be insured.

What is claimed is:

1. A toner for two-component developer characterized in that the surface area (A) of toner mother particles containing linear polyester resin and coloring agents and the total projection area (B) of external additives in diameter less than 50 nm, that are added to the surface of the toner mother particle is 75%≦B/A≦150%.

2. The toner according to claim 1, wherein the external additive comprises inorganic oxide containing at least silica ($SiO_2$) and the total projection area (C) and the total projection area (D) of the inorganic oxides are as follows:

$$70\% \leqq C/A \leqq 100\%$$

$$5\% \leqq D/A \leqq 50\%.$$

3. The toner according to claim 1, wherein an acid value of the linear polyester resin is 5–30 KOHmg/g and a glass transition point is 45–65° C.

4. The toner according to claim 3, wherein the external additives comprise inorganic oxides containing at least silica ($SiO_2$) and the total projection area (C) and the total projection area (D) of the inorganic oxide are as follows:

$$70\% \leqq C/A \leqq 100\%$$

$$5\% \leqq D/A \leqq 50\%.$$

5. A color image forming apparatus comprising:

plural image carriers;

plural image forming means for forming developer images in different colors on the plural image carriers using a toner for two-component developer of which the surface area (A) of the toner mother particles containing linear polyester resin and coloring agents and the total projection area of an external additive in diameter less than 50 nm that is added to the surface of the toner mother particles is 75%≦B/A≦150%;

transfer means for transferring the developer images in different colors formed on the plural image carriers on an image receiving medium by superposing; and fixing means for fixing the developer image in different colors transferred on the image receiving medium by superposing.

6. The color image forming apparatus according to claim 5, wherein the external additives for the toner for two-component developer comprises inorganic oxides containing at least silica ($SiO_2$), and the total projection area (C) of the silica ($SiO_2$) and the total projection area (D) of the inorganic oxides are 70%≦C/A≦100% and 5%≦D/A≦50%.

7. The color image forming apparatus according to claim 5, wherein an acid value of the linear polyester resin of the two-component developer toner is 5–30 KOHmg/g and a glass transition point is 45–65° C.

8. The color image forming apparatus according to claim 7, wherein the external additives for the toner for two-component developer comprises inorganic oxides containing at least silica ($SiO_2$) and the total projection area (C) of silica ($SiO_2$) and the total projection area (D)of the inorganic oxides are as follows:

$$70\% \leqq C/A \leqq 100\%$$

and $$5\% \leqq D/A \leqq 50\%.$$

9. The color image forming apparatus according to claim 5, wherein the transfer means includes a 85–150 $\mu$m thick transferring belt having a volume resistivity $10^9$–$10^{11}$ Ω/cm; and charge applying rollers for applying 800–3,000 V transferring bias to give transferring charge to the transferring belt.

10. A color image forming method comprising the steps of:

forming developer images in different colors on plural image carriers using a toner for two-component developer of which the surface area (A) of the toner mother particles containing linear polyester resin and coloring agents and the total projection area of an external additive in diameter less than 50 nm that is added to the surface of the toner mother particles is $75\% \leqq B/A \leqq 150\%$;

transferring the developer images in different colors formed on the plural image carriers on an image receiving medium by superposing; and fixing the developer image in different colors transferred on the image receiving medium by superposing.

11. The method according to claim 10, wherein the external additives for the toner for two-component developer comprises inorganic oxides containing at least silica ($SiO_2$), and the total projection area (C) of the silica ($SiO_2$) and the total projection area (D) of the inorganic oxides are $70\% \leqq C/A \leqq 100\%$ and $5\% \leqq D/A \leqq 50\%$.

12. The method according to claim 10, wherein an acid value of the linear polyester resin of the two-component developer toner is 5–30 KOHmg/g and a glass transition point is 45–65° C.

13. The method according to claim 12, wherein the external additives for the toner for two-component developer comprises inorganic oxides containing at least silica ($SiO_2$) and the total projection area (C) of silica ($SiO_2$) and the total projection area (D)of the inorganic oxides are as follows:

$$70\% \leqq C/A \leqq 100\%$$

and $$5\% \leqq D/A \leqq 50\%.$$

* * * * *